US008323127B2

(12) United States Patent
Webb et al.

(10) Patent No.: US 8,323,127 B2
(45) Date of Patent: Dec. 4, 2012

(54) SPORTS THROWING TRAINING DEVICE

(76) Inventors: Dennis A. Webb, New Palestine, IN (US); Lake D. Webb, New Palestine, IN (US)

( * ) Notice: Subject to any disclaimer, the term of this patent is extended or adjusted under 35 U.S.C. 154(b) by 0 days.

(21) Appl. No.: 12/479,379

(22) Filed: Jun. 5, 2009

(65) Prior Publication Data

US 2009/0305827 A1 Dec. 10, 2009

Related U.S. Application Data

(60) Provisional application No. 61/059,454, filed on Jun. 6, 2008.

(51) Int. Cl.
*A63B 69/00* (2006.01)
*A63B 69/26* (2006.01)
*A63B 69/30* (2006.01)

(52) U.S. Cl. ..... 473/458; 473/422

(58) Field of Classification Search ..... 473/458, 473/450, 464, 422, 438, 212–217; 482/121, 482/124–126

See application file for complete search history.

(56) References Cited

U.S. PATENT DOCUMENTS 650,656 A * 5/1900 Raabe ..... 482/124
866,495 A * 9/1907 Marks ..... 482/124
2,274,574 A * 2/1942 Zerne ..... 482/129
3,162,441 A * 12/1964 Karlik ..... 482/124
3,888,482 A 6/1975 Starrett et al.
4,875,677 A 10/1989 Tetreault
4,984,789 A 1/1991 Socci
5,137,272 A * 8/1992 Wilkinson ..... 482/124
5,176,377 A * 1/1993 Wilkinson ..... 482/120
5,348,292 A 9/1994 Norman, Sr.
5,358,461 A * 10/1994 Bailey, Jr. ..... 482/2
5,375,836 A 12/1994 Kiser
5,431,617 A * 7/1995 Rattray, Jr. ..... 482/129
5,618,249 A * 4/1997 Marshall ..... 482/127
5,647,827 A * 7/1997 Gutkowski et al. ..... 482/124
5,792,034 A * 8/1998 Kozlovsky ..... 482/124
5,993,362 A * 11/1999 Ghobadi ..... 482/124
6,132,346 A * 10/2000 Weeks ..... 482/124
6,270,430 B1 8/2001 Nicoloff
6,280,365 B1 * 8/2001 Weber et al. ..... 482/124
6,585,611 B2 7/2003 Vogel
6,629,912 B2 * 10/2003 Downs ..... 482/124
6,755,755 B2 6/2004 Wah Loh (Continued)

OTHER PUBLICATIONS

2006. The Hygenic Corporation. "Thera-Band: Home Fitness & Professional Rehab." www.thera-band.com/exercise_station.html.

*Primary Examiner* — Mitra Aryanpour
(74) *Attorney, Agent, or Firm* — Stewart & Irwin, P.C.; Dennis S. Schell

(57) ABSTRACT

A sports training device is worn by the trainee for developing skill and minimizing risk of injury in pitching, passing, swinging, kicking, and other such sports-related body movements. An illustrative embodiment includes an anchor member adapted for wear on the torso of a trainee, a first tension device coupled between a trainee's arm and the anchor member, and a second tension device coupled between a trainee's leg and the anchor member. The first tension device may include a bendable rod and elastic cord, the bendable rod selectively rotatable to adjust the rod and cord relative to a trainee's shoulder.

20 Claims, 6 Drawing Sheets

U.S. PATENT DOCUMENTS

| | | | | |
|---|---|---|---|---|
| 6,875,135 | B2 | 4/2005 | Tracy, Sr. | |
| 7,074,139 | B2 | 7/2006 | Vogel | |
| 7,297,090 | B2 * | 11/2007 | Torres | 482/74 |
| 7,628,742 | B2 * | 12/2009 | Weaver | 482/125 |
| 2002/0193188 | A1 | 12/2002 | Wah Loh | |
| 2003/0125170 | A1 * | 7/2003 | Vernon | 482/124 |
| 2003/0232669 | A1 | 12/2003 | Smith et al. | |
| 2004/0033850 | A1 | 2/2004 | Socci | |
| 2004/0053755 | A1 * | 3/2004 | Wilkinson | 482/124 |
| 2009/0098945 | A1 * | 4/2009 | George | 473/458 |

* cited by examiner

SPORTS THROWING TRAINING DEVICE

CROSS-REFERENCE TO RELATED APPLICATION

This application claims the benefit of U.S. Provisional Patent Application No. 61/059,454, filed Jun. 6, 2008, and titled SPORTS THROWING TRAINING DEVICE, which is incorporated herein by reference.

FIELD OF THE INVENTION

The present disclosure relates to sports training devices, and particularly to a device worn by a trainee for strengthening throwing, such as pitching and passing, or other sports related body movements, including swinging and kicking.

BACKGROUND

Various sports motions such as pitching, throwing, passing, kicking, and swinging generally involve propelling a projectile like a ball or swinging an implement such as a bat. The skill of the trainee seeking to improve such sports motions and to prevent or minimize the risk of injury generally includes training to improve body strength, balance, speed of movement, and control/coordination of movement.

For example, when pitching a baseball, the strength, control, coordination, and speed associated with the trainee's glove-side leg motion or stride, the trainee's throwing arm, and the trainee's core muscles (muscles of the torso, i.e., other than those of the arms and legs) are essential in developing pitching skill and avoiding injury.

Various sports training devices provide training for sports motions. Some devices offer elastic or weight and pulley-based resistance between an attachment point on the trainee's body and an anchor point located on a machine, wall, floor, pole, or other fixed structure. However, such off-body anchoring disturbs the trainee's balance, provides a resistance vector not adequately related to the trainee's body mechanics, and typically does not provide for the desired full range of motion or an actual release of or contact with a ball. Other sports training devices are worn by the trainee and lack off-body anchoring; however, such devices typically only provide various structures that limit or guide motion and do not offer resistance to improve core or peripheral body strength. Yet other sports training devices do provide resistance between an attachment point on the trainee's body and an anchor point on the trainee's body but fail to offer resistance to both an attachment point on the arm and an attachment point on the leg, thus these devices are limited to strengthening one peripheral member and also may provide negative training of coordination of movement. Weighted balls sometimes used for such training risk overstressing and damaging muscles and joints such as the shoulder.

SUMMARY OF THE INVENTION

The present invention may comprise one or more of the following features and combinations thereof.

An illustrative sports training device includes an anchor member adapted for wear on the torso of a trainee, a first tension device coupled between a medial or distal portion of a trainee's arm and the anchor member, and, optionally, a second tension device coupled between a medial or distal portion of a trainee's leg and the anchor member. In one illustrative embodiment, the tension device includes an elastic cord. The distal portion of the trainee's arm may include a hand, wrist, or area distal of the elbow. The medial portion of the trainee's arm is proximal of the elbow, for example, the bicep. The distal portion of the trainee's leg may be an ankle, heel, foot, lower leg or distal of the knee. The medial portion of the trainee's leg is proximal of the knee, for example, the thigh. In one illustrative embodiment, the training device includes a cuff adapted to couple the first tension device to the trainee's bicep. The training device, in one embodiment, includes a harness adapted to couple the second tension device to the trainee's thigh.

In one illustrative embodiment, at least one of the first and second tension devices is adapted to provide selective adjustment of tension. The anchor member provides a plurality of tension mounts for at least one of the first and second tension devices in one embodiment.

Although an illustrative embodiment is configured for baseball pitching training, other embodiments may be configured for a different sport or athletic motion, and one illustrative embodiment of the device is reconfigurable for use with various sports and athletic motions, including, but not limited to passing, throwing, swinging, and kicking, and/or for trainees having different heights or strengths. For example, the first and/or second tension device may be coupled to a different tension mount on the anchor member and/or a different attachment point on the trainee's arm and/or trainee's leg depending on the motion for which the trainee is training.

Advantageously, the illustrative device is portable and can be used wherever worn by the trainee. Strengthening core muscle groups and specific muscle units reduces risk of injury to joints and tendons, for example, those of the elbow and shoulder.

Additional features of the disclosure will become apparent to individuals skilled in the art upon consideration of the following detailed description of the illustrative embodiment.

BRIEF DESCRIPTION OF THE DRAWINGS

The detailed description particularly refers to the accompanying figures in which.

DETAILED DESCRIPTION OF THE ILLUSTRATIVE EMBODIMENTS

Figure 1:
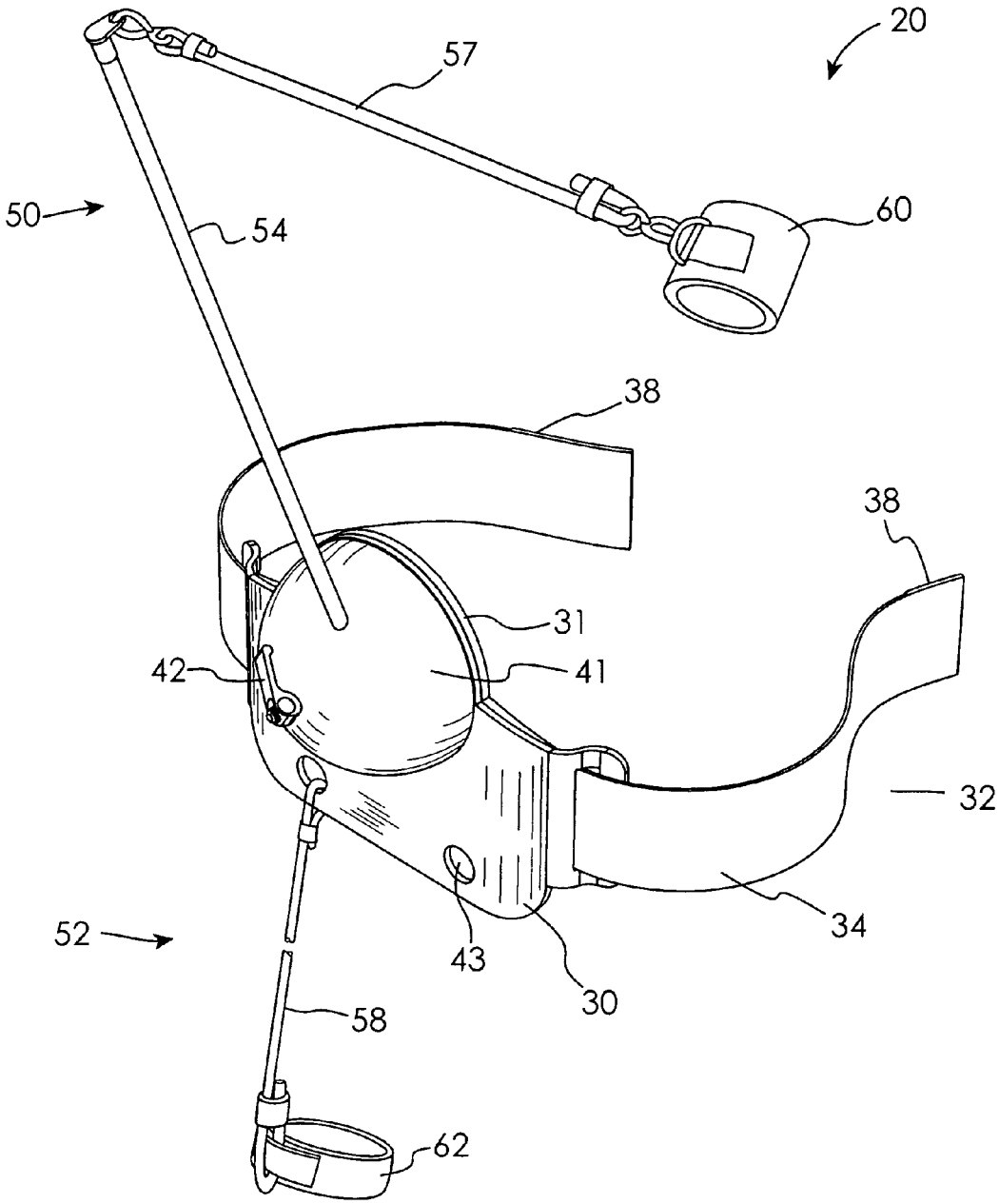
FIG. 1 is a perspective view of a first illustrative embodiment of a sports training device.

For the purposes of promoting and understanding the principals of the invention, reference will now be made to one or more illustrative embodiments illustrated in the drawings and specific language will be used to describe the same.

Referring to FIGS. 1 through 5, a first illustrative embodiment of a sports training device 20 is shown. The training device 20 includes an anchor member 30 which is worn on a trainee's torso 24, for example, adjacent the back portion of the torso 24. In the illustrative embodiment, the anchor member 30 is planar with a slight curvature side-to-side to fit and be retained in position on the backside of the torso 24 by a restraint 32. For example, the restraint 32 may include one or more belts, ties, a harness, a vest, buckles, or other releasable or wearable features for fixing the position of the anchor member 30 relative to the torso 24.

The illustrative training device 20 also includes a first tension device 50, including, for example, an elastic cord 57, a first attachment device 60 adapted to couple the distal end of the elastic cord 57 to a trainee's arm 66, a tension mount 54 coupling a proximate end of the elastic cord 57 to the anchor member 30, and a member 41 for securing the tension mount 54 to the anchor member 30. Optionally, the illustrative training device 20 can also include a second tension device 52, including, for example, an elastic cord 58 coupled between the anchor member 30 and a second attachment device 62, which is adapted to be coupled to a trainee's leg 70.

Any rigid or semi-rigid material may be used to manufacture the anchor member 30, including, for example, Aquaplast® brand material (a trademark of and available from Paterson Medical/Sammons Preston, of Bolingbrook, Ill.), which is sloughed, heated, and melted over a formed template, rather than formed using a costly molding process.

Figure 2:
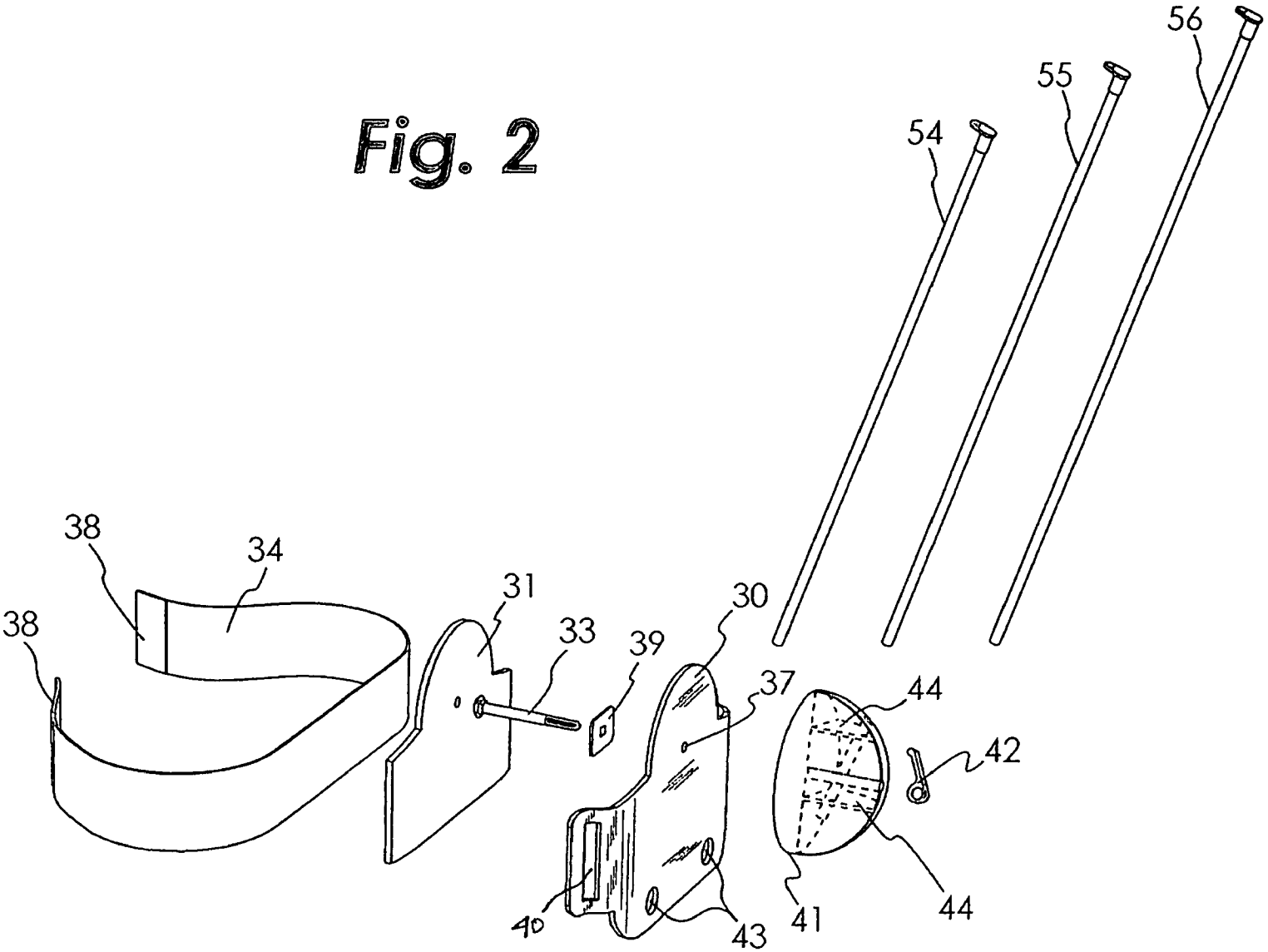
FIG. 2 is an exploded view of the sports training device of FIG. 1.

In the first illustrative embodiment, as shown in FIGS. 1 and 2, the restraint 32 includes a web belt 34 and a hook and loop fastener 38. The restraint 32 is coupled, releasably or non-releasably, with the anchor member 30. For example, the belt 34 extends through a pair of slots 40 formed by opposite side portions of the anchor member 30. Alternatively, the restraint 32 may be integral with the anchor member 30. The restraint 32 is releasably coupled with the trainee's torso 24, for example, by securing the hook and loop fastener 38 such that the belt 34 fits snugly around the torso 24, thus substantially preventing movement of the anchor member 30 relative to the torso 24. The hook and loop fastener 38 can be composed of a fabric hook and loop fastener, such as that sold under the VELCRO brand name, but, additionally or alternatively, can include buckles and other releasable mechanisms for fastening. In addition, standard weightlifting belts may be implemented as the restraint 32.

In the illustrative embodiment as depicted in particular in FIG. 2, member 41 is coupled to the anchor member 30 at a fastening point defined by the position of a fastener 33 and provides a means of securing one of tension mounts 54-56 to the anchor member 30. The member 41, in this illustrative embodiment, is selectively-rotatable for rotating one of the tension mounts 54-56 relative to the anchor member 30 and thus to shoulder 35 of the trainee. The rotatable member 41 is selectively and rotatably secured to the anchor member 30, for example, by cam lever locking means 42, or a washer 39 and the fastener 33 extending through the washer 39 and an aperture 37 defined in the anchor member 30. The cam lever locking means 42 includes any lever or switch pivotally-mounted on the fastener 33 and capable of pressing the selectively-rotatable member 41 against the anchor member 30 when turned to one position, thus preventing rotation, and slightly separating the selectively-rotatable member 41 and anchor member 30 when turned to an alternate position, thus allowing rotational adjustment of member 41 and one of the tension mounts 54-56. The selectively-rotatable member 41, then, is capable of selective rotation about the axis provided by the fastener 33.

Figure 3:
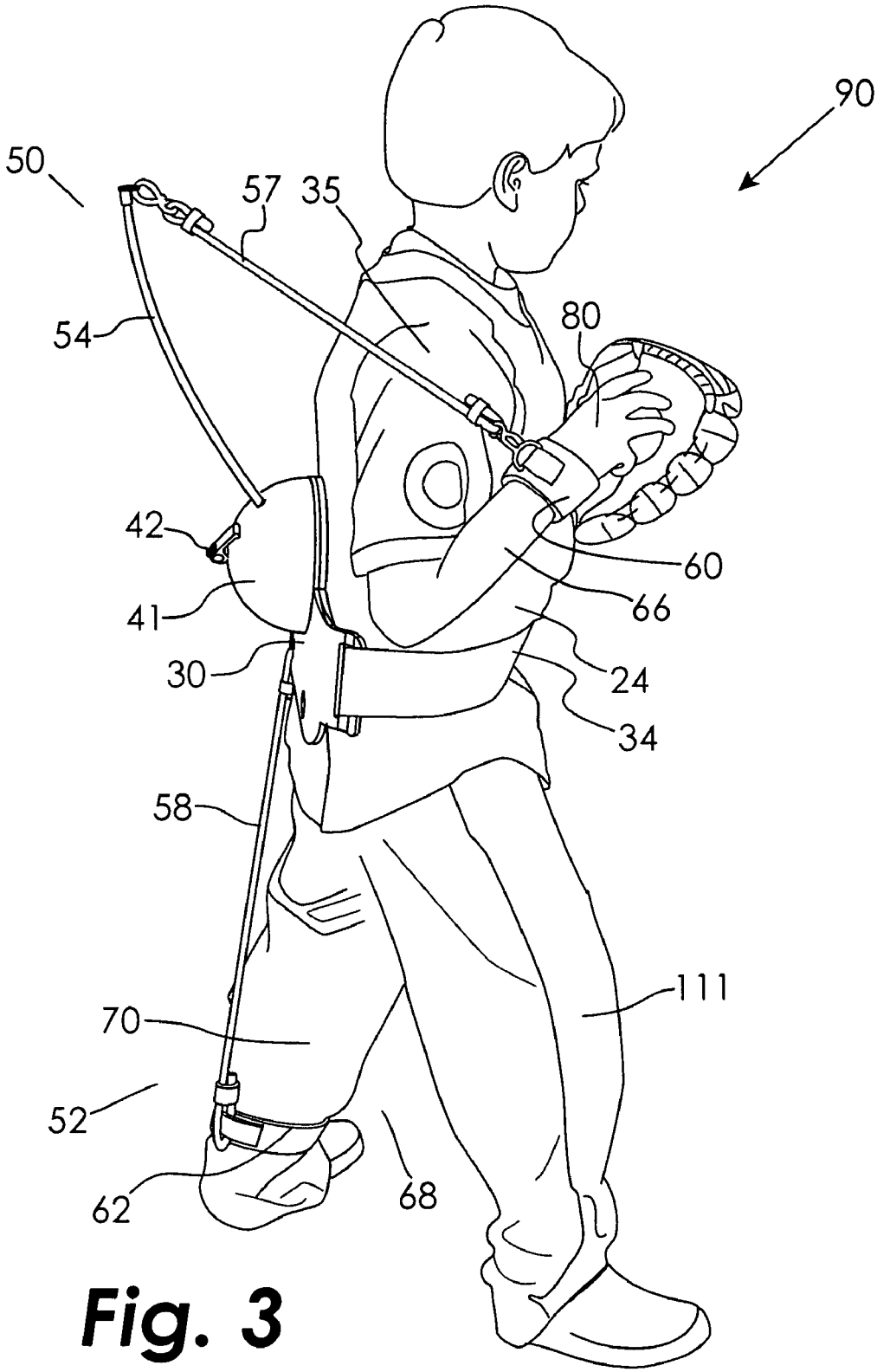
FIG. 3 is a side view of the sports training device of FIG. 1 being worn by a trainee according to the present disclosure.
Figure 4:
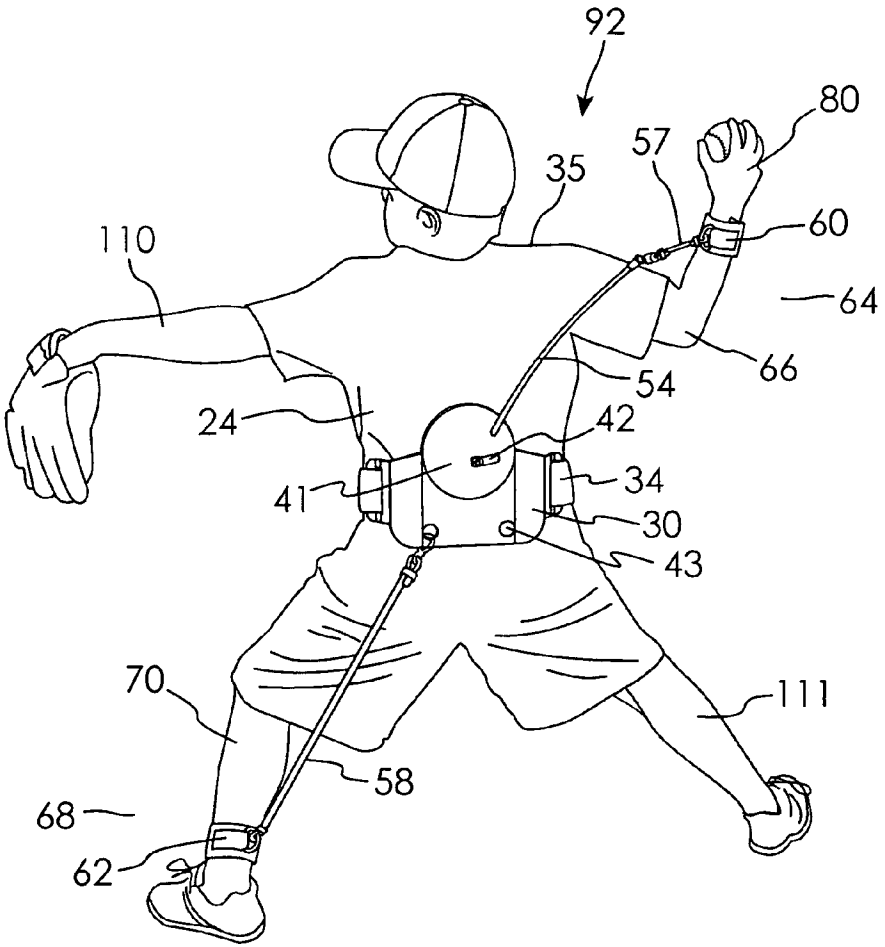
FIGS. 4 and 5 are a sequence of views illustrating the sports training device worn by the trainee of FIG. 3 while executing a baseball pitch.
Figure 5:
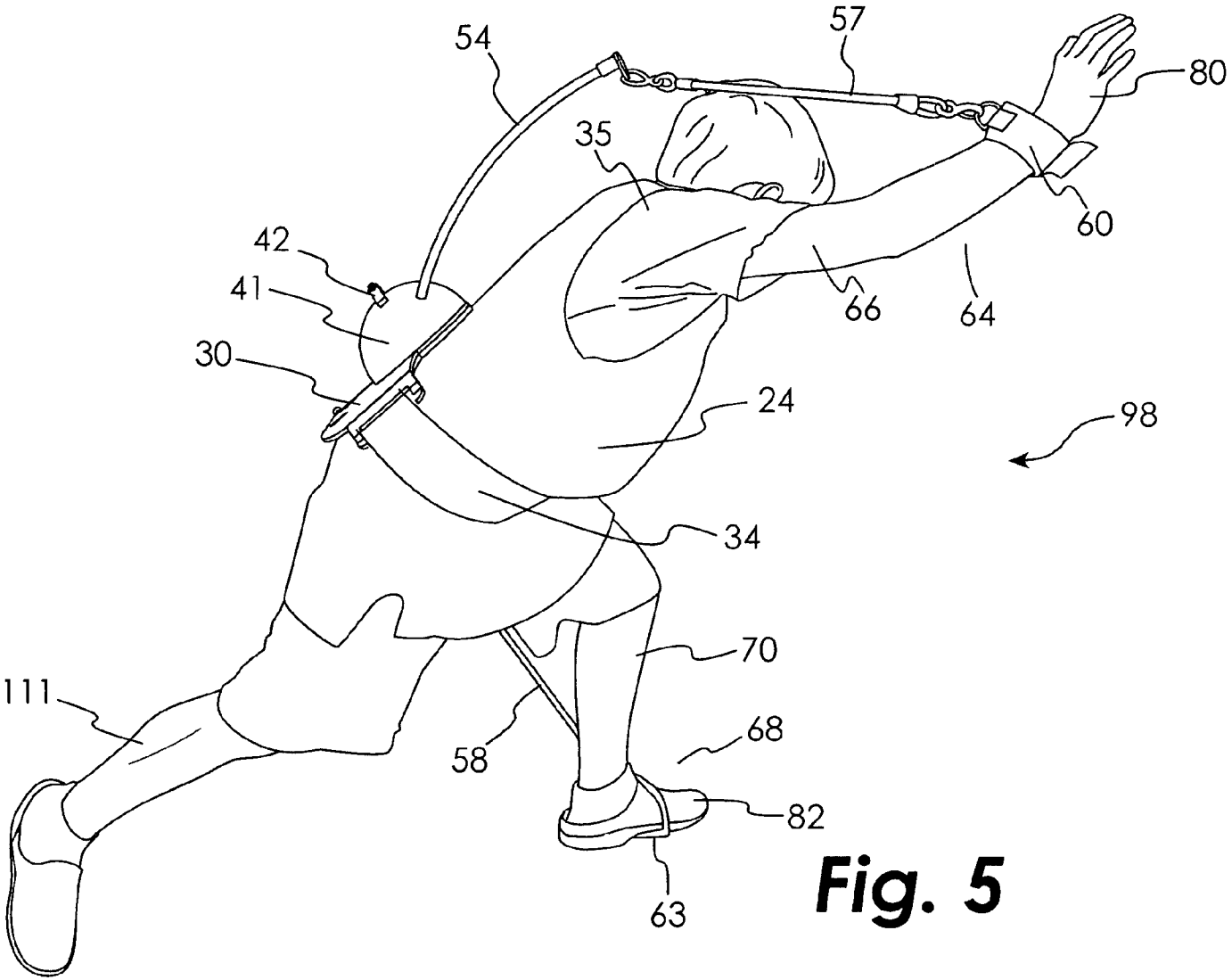

In one embodiment, the first tension device 50 consists of the tension mounts 54-56, which are bendable rods, for example, fiberglass rods, coupled at their distal ends, with the elastic cord 57 and coupled, for example, releasably, at their proximal ends, with the selectively-rotatable member 41. The tension mounts 54 can be resiliently bendable under tension from movement of the trainee's arm 66, as shown in FIGS. 3 and 5, and reform unaided to their unbent position when not in tension, as shown in FIGS. 1, 2, and 4. The number of tension mounts 54-56 which may be employed in turn is not limited. The anchor member 30 can also have at least one aperture 43 through which the elastic cord 58 may pass and be secured; this aperture 43 may include protective eyelets, bearings, bushings, and/or anti-friction features.

As shown in FIGS. 3-5, the first attachment device 60 provides coupling of the first tension device 50 with a distal portion 64 of a throwing/swinging arm 66. Alternatively, the first attachment device 60 can be coupled with a medial portion of the arm 66, for example, proximate to the bicep. The second attachment device 62 is optional and provides coupling of the second tension device 52 with a distal portion 68 of a trainee's leg 70, for example, the leg 70 being the one opposite the arm 66. This lower-body tension can provide lower-body/core strength training and provides stability to anchor member 30 to counteract the upper-body motion and tension. Alternatively, the second tension device 52 is coupled with the thigh of the trainee's leg 70.

The selectively-rotatable member 41 can be composed of spun metal or plastic and hollow; optionally, on its interior, the selectively-rotatable member 41 can include guide plates 44 with defined openings to guide and/or secure whichever of the tension mounts 54-56 is inserted therein. In one embodiment, the tension mounts 54-56 are threaded at their proximal ends and screw into the selectively-rotatable member 41; however, other retaining means, for example, a tether, may be utilized. In yet another embodiment, the member 41 is a fixed receiver for the tension mounts 54-56 and does not rotate.

In the first illustrated embodiment, the first attachment device 60 is a strap and the second attachment device 62 may be a strap or a harness. The first attachment device 60 may also be a glove adapted to be worn on a hand 80 of the trainee's arm 66 and to releasably, nonreleasably, or integrally couple with the first tension device 50. Alternatively or additionally, the first attachment device 60 may be a different member adapted to releasably couple to a different portion trainee's arm 66, for example, a harness, sling, band, or other member coupled to one or more of the upper arm, elbow, forearm, wrist, hand, or digits of the distal arm portion 64 or medial arm portion. In one embodiment, the training device 20 includes a plurality of different first attachment devices 60 which may be selectively coupled with the anchor member 30 by releasably coupling the first tension device 50 to at least one of the attachment devices 60 or the anchor member 30.

Similarly, FIG. 5 shows the second attachment device 62 may be a harness 63 adapted to releasably couple with a foot 82 of the trainee's leg 70 and to releasably, nonreleasably, or integrally couple with the second tension device 52. Alternatively or additionally, as seen in FIGS. 3 and 4, the second attachment device 62 may be a different member adapted to releasably couple to a different position on the distal leg portion 68 or even a medial portion such as the thigh. For example, a sling, band, shoe, or other member can be coupled to one or more of the knee, calf, ankle, or foot of the distal leg portion 68. In one embodiment, the training device 20 includes a plurality of different second attachment devices 62 that may be selectively coupled with the anchor member 30 by releasably coupling the second tension device 52 to at least one of the attachment devices 62 or the anchor member 30.

In the first illustrated embodiment, the first and second tension devices 50 and 52 each include, respectively, elastic cords 57 and 58. The cords 57 and 58 may consist of, for example, surgical tubing and their tension, including the resistance to extension of the cord length and the recoil force to retract the cord length in this embodiment, is determined by the particular elastic properties of the cord selected, the resting length of the cord, for example between the first attachment device 60 and the tension mount 54, and the range of motion of the trainee's arm 66. Color coding may be employed to easily identify the resistance and/or length of the cords 57 and 58.

Tension can be selectively changed, for example, by using a different cross section or cord material or by retying or otherwise adjusting to provide a different resting length between the first attachment device 60 and the tension mount 54. The particular one of the tension devices 50 or 52 and its location and displacement relative to the distal arm portion 64, or a medial arm portion, and the distal leg portion 68, or a medial leg portion, will also selectively change the tension provided by the training device 20. The resulting tensions for extension and retraction may be symmetric or asymmetric.

In other embodiments, the tension devices 50 and 52 and tension mounts 54-56 may include other members that each provide a fixed or selective tension between the anchor member 30 and the respective distal arm portion 64, or a medial arm portion, and the distal leg portion 68, or a medial leg portion. For example, the combination of the respective tension mounts 54-56 and the elastic cords 57 and 58 may provide a substantially uniform tension, increasing tension, decreasing tension, or some combination thereof, relative to the extension and/or retraction through a range of motion for the arm 66 or leg 70.

The tension may be a bell-shaped curve relative to extension and range of motion. Tension may be provided by the properties of the material used, as in the case of an elastic member in the illustrative embodiment, or, additionally or alternatively, may be provided by mechanical or electromechanical features associated with one or more of the tension devices 50 and 52 and tension mounts 54-56. For example, tension devices 50 and 52 may be or include substantially non-elastic cords associated with winding reels or features such as levers, pulleys, gears, springs, motors, and the like arranged and adapted to provide a selectable or non-selectable force to tension and/or wind/unwind a cord or other member, including a selectable or nonselectable resistance to extension and/or a selectable or nonselectable force for retraction.

The training device 20 may also include comfort and/or safety devices. For example, a comfort pad 31 may be utilized between the anchor member 30 and the trainee's torso 24. As contemplated, the comfort pad is coupled to the anchor member 30 and could be made of material such as memory foam.

FIGS. 3-5 illustrate the use of the training device 20 through a range of motion of the trainee's arm 66, in this case the pitch of a baseball. Specifically, FIG. 3 illustrates a ready position 90, FIG. 4 a windup position 92, and FIG. 5 a release position 98. As the motion and position associated with the trainee's arm 66, leg 70, torso 24, and opposite arm 110 and leg 111 change, a particular tension vector is applied to the arm 66 and, optionally, the leg 70, thereby providing the desired conditioning relating to pitching and body strength, balance, speed of movement, and control/coordination of movement.

Figure 6:
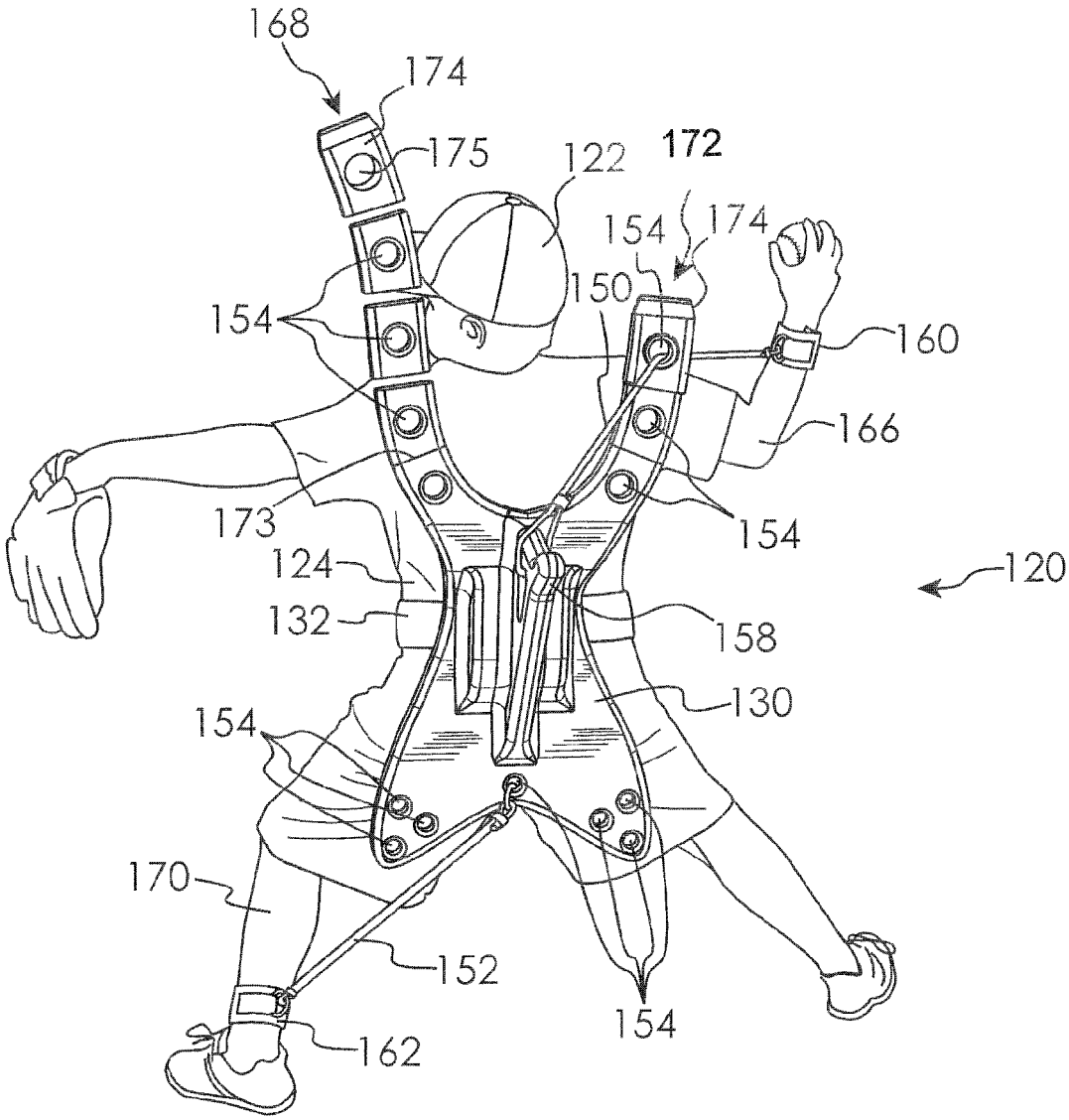
FIG. 6 is a frontal view of a second illustrative embodiment of a sports training device being worn by a trainee.

Referring to FIG. 6, a second illustrative embodiment of a sports training device 120 is shown in use by a trainee 122. The training device 120 may selectively include the features of the training device 20, some of which are discussed below, and also may include additional or alternative features, some of which are discussed below.

The training device 120 includes an anchor member 130, a first tension device 150, a second tension device 152, guides 154, at least one tension mount 158, a first attachment device 160, and a second attachment device 162.

Anchor member 130 is worn on the trainee's torso 124, held in place by a restraint 132, and can be formed from a rigid or semi-rigid material, for example, from a closed cell expandable foam such as expanded polypropylene. The anchor member 130 includes at least one generally vertical extension 168 and 172, optionally aligned with the shoulder of the trainee 122. The vertical extension 172 includes at least one guide 154 through which the first tension device 150 may pass. Additionally or alternatively, the anchor member 130 includes at least one guide 154 through which the second tension device 152 is capable of passing.

The vertical extensions 168 and 172, in this embodiment, are capable of being cut by the trainee 122 and customized by virtue of scoring lines 173 indicating optimal locations for cutting, as illustrated for vertical extension 168, with one possible object being to make the top of the vertical extensions 168 and 172 level with the shoulder of the trainee 122, for comfort and so as not to impede motion, as illustrated for vertical extension 172. A rigid, for example, plastic, cap 174 is sized to securely cover the top of the vertical extensions 168 and 172 and has an aperture 175 through which the first tension device 150 may pass.

The tension mount 158 facilitates and/or provides coupling of the first and second tension devices 150 and 152 with the anchor member 130 and can be located over the restraint 132 and a lower back portion of the trainee 122, thus providing stability throughout a range of motion for the anchor member 130 and the trainee 122. The first attachment device 160 provides coupling of the first tension device 150 with a throwing/swinging arm 166. The second attachment device 162 provides coupling of the second tension device 152 with a trainee's leg 170, for example, the leg 170 opposite the throwing/swinging arm 166.

In the second illustrative embodiment, the tension mount 158 is a member positioned orthogonally to the anchor member 130 and projecting outwardly from the trainee 122. In one embodiment, the tension mount 158 extends at least three inches from the anchor member 130.

The guides 154 are located to facilitate the providing of resistance to the movement of the arm 166, or an opposite arm, from desired locations that make possible proper training of motion and strength, including various heights on the vertical extensions 168 and 172. Each of the guides 154 may also, or in the alternative, include protective eyelets, bearings, bushings, and/or anti-friction features, such as roller bearings or the like. Also, or alternatively, each of the guides 154 may include other features for tensioning or for releasably, non-releasably, or integrally coupling at least one of the first and second tension devices 150 and 152. In the second illustrated embodiment, the first attachment device 160 can include a releasably attached wrist band, and the second attachment device 162 can include a foot harness.

Other locations and populations of guides 154, vertical extensions 168 and 172, and tension mounts 158 are contemplated. For example, a single common tension mount may be used for both tension devices 150 and 152 and/or a rotary tension mount could be implemented. The training device 20 may also include comfort and/or safety devices, including, but not limited to, a back cushion pad.

The first and second training devices 20 and 120 may also be used for typical strengthening and/or toning exercises, for example, standing bench presses, curls, and squats.

While the invention has been illustrated and described in detail in the foregoing drawings and description, the same is to be considered as illustrative and not restrictive in character, it being understood that only illustrative embodiments thereof have been shown and described and that all changes and modifications which are within the scope of the claimed subject matter are desired to be protected.

What is claimed is:

1. A sports training device, comprising:

an anchor member including a restraint for coupling the anchor member to the torso of a trainee;

a first tension device including at least one tension mount defining a first end of the first tension device, a first end of the at least one tension mount coupled centrally on the anchor member; and a first attachment device coupled to a second end of the first tension device, the first attachment device for coupling the first tension device to a trainee's arm; and wherein the at least one tension mount being elongate and resiliently bendable along an elongate axis upon movement of trainee's arm, the first end of the at least one tension mount is positioned directly over the trainee's small of the back and the at least one tension mount projects upwardly at an angle wherein a second end of the at least one tension mount is positioned behind a shoulder of the trainee's arm when the anchor member is coupled to the torso of the trainee and the first tension device is coupled to the trainee's arm.

2. The sports training device according to claim 1, the first tension devices includes a cord tethered to the second end of the at least one tension mount.

3. The sports training device according to claim 1, wherein the first tension devices is adapted to provide selective adjustment of tension.

4. The sports training device according to claim 1, further comprising a member connected to the anchor member and securing at least one tension mount such that the at least one tension mount is selectively rotatable relative to the anchor member.

5. A sports training device comprising:

an anchor member including a restraint for coupling the anchor member to the torso of a trainee;

a first tension device coupled at a first end to the anchor member;

a first attachment device coupled to a second end of the first tension device, the first attachment device for coupling the first tension device to a trainee's arm;

wherein the first tension device includes a resiliently bendable rod coupled between the anchor member and the first attachment device; and a member coupling the anchor member and rod such that a first end of the rod is positioned centrally on the anchor member and is rotatable relative to the anchor member to align a distal end of the rod with a shoulder of the trainee.

6. The sports training device according to claim 5, wherein the member defines an opening into which a portion of the rod is received and secured.

7. The sports training device according to claim 6, wherein the member is selectively secured from rotation relative to the anchor member by a cam lever locking means.

8. The sports training device according to claim 1, wherein the restraint includes a releasable belt for securing the training device about a trainee's torso.

9. The sports training device according to claim 1, wherein the at least first one tension mount is resiliently bendable under tension from movement of the trainee's arm, and reforms unaided to an unbent position when not in tension.

10. The sports training device according to claim 1, further comprising:

a second tension device coupled at a first end to the anchor member, and a second attachment device coupled to a second end of the second tension device, the second attachment device for coupling the second tension device to a trainee's leg.

11. The sports training device according to claim 1, wherein the at least one tension mount includes a plurality of selectively interchangeable rods, each of the plurality of selectively interchangeable rods providing a different tension through a range of motion of the trainee's arm.

12. A sports training device comprising:

an anchor member including a restraint for coupling the anchor member to the torso of a trainee;

a tension mount having a proximal end coupled to the anchor member, the tension mount including a bendable rod;

a first tension cord having a first end, the first end tethered to the distal end of the tension bendable rod; and a first attachment device coupled to a second end of the first tension cord, the first attachment device for coupling the tension cord to an arm of a trainee, the distal end of the tension mount positioned proximate the shoulder of a trainee upon the tension cord being coupled to an arm of the trainee.

13. The sports training device according to claim 12, wherein the tension mount is adapted to selectively rotate about an axis perpendicular to a plane generally defined by the anchor member.

14. The sports training device according to claim 12, wherein the tension mount includes a selected one of a plurality of rods interchangeable with the bendable rod and positioned at an acute angle between the anchor member and behind a shoulder of the trainee.

15. The sports training device according to claim 12, further comprising a second tension cord coupled at a first end to the anchor member and a second attachment device coupled to a second end of the second tension cord, the first attachment device for coupling the second tension cord to a leg of a the trainee.

16. A sports training device comprising:

an anchor member including a restraint for coupling the anchor member to the torso of a trainee;

a first tension device coupled at a first end to the anchor member;

an attachment device coupled to a second end of the first tension device, the attachment device for coupling the first tension device to a trainee's arm;

the first tension device including a tension mount and a cord, the tension mount positioned orthogonal to the anchor member, the tension mount having a connecting point to which the cord may be secured; and wherein the anchor member includes at least one vertical extension having a top end proximate to the shoulder of the trainee, removable segments, and at least one opening defined by each of the removable segments of the vertical extension through which the cord is positionable.

17. The sports training device according to claim 16, further comprising a second tension device having a first end coupled to the anchor member and a second end coupled to a trainee's leg.

18. The sports training device according to claim 16, wherein the anchor member includes at least one vertical extension having at least one opening through which a tension device may pass.

19. The sports training device according to claim 16, wherein a height of the vertical extension from a base of the vertical extension to the top end is customizable.

20. The sports training device according to claim 19, further comprising a cap fittable over a severed end of the vertical extension.

* * * * *